US009598934B2

(12) United States Patent
Cunningham et al.

(10) Patent No.: US 9,598,934 B2
(45) Date of Patent: Mar. 21, 2017

(54) CRIMPING TO ADJUST FLUID FLOW FOR AUTONOMOUS INFLOW CONTROL DEVICES

(71) Applicant: Halliburton Energy Services, Inc., Houston, TX (US)

(72) Inventors: Gregory Scott Cunningham, Grapevine, TX (US); Jean Marc Lopez, Plano, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 244 days.

(21) Appl. No.: 14/390,600

(22) PCT Filed: Dec. 17, 2013

(86) PCT No.: PCT/US2013/075538

§ 371 (c)(1),
(2) Date: Oct. 3, 2014

(87) PCT Pub. No.: WO2015/094172

PCT Pub. Date: Jun. 25, 2015

(65) Prior Publication Data

US 2016/0273310 A1 Sep. 22, 2016

(51) Int. Cl.
*E21B 41/00* (2006.01)
*E21B 34/08* (2006.01)
(Continued)

(52) U.S. Cl.
CPC ..... *E21B 41/00* (2013.01); *E21B 34/08* (2013.01); *E21B 43/14* (2013.01); *E21B 33/12* (2013.01); *E21B 43/08* (2013.01)

(58) Field of Classification Search
USPC ..... 166/380
See application file for complete search history.

(56) References Cited

U.S. PATENT DOCUMENTS 5,464,062 A * 11/1995 Blizzard, Jr. ..... E21B 33/127 166/100
2002/0096333 A1 7/2002 Johnson et al.
(Continued)

FOREIGN PATENT DOCUMENTS

WO 2004101950 A1 11/2004

OTHER PUBLICATIONS

International Search Report and Written Opinion for PCT/US2013/075538 dated Sep. 17, 2014.

*Primary Examiner* — Taras P Bemko
(74) *Attorney, Agent, or Firm* — McDermott Will & Emery LLP

(57) ABSTRACT

Disclosed are wellbore flow control devices that allow on-site field adjustments to flow characteristics. One autonomous inflow control device (AICD) assembly includes a housing arranged about a base pipe that defines at least one flow port and an interior, the housing defining a fluid compartment in fluid communication with the at least one flow port, an AICD arranged in the fluid compartment and having at least one fluid inlet and an outlet in fluid communication with the at least one flow port, a shroud coupled to the housing and covering the fluid compartment, and a crimping tool arrangeable about the housing and the shroud and having a profile defined thereon, the profile being configured to engage and plastically deform the shroud in order to fluidly isolate the AICD.

20 Claims, 5 Drawing Sheets

(51) Int. Cl.

| | |
|---|---|
| ***E21B 43/14*** | (2006.01) |
| *E21B 33/12* | (2006.01) |
| *E21B 43/08* | (2006.01) |

(56) References Cited

U.S. PATENT DOCUMENTS

| | | | | |
|---|---|---|---|---|
| 2006/0151174 | A1* | 7/2006 | Cantin | E21B 21/103 166/334.1 |
| 2008/0224085 | A1 | 9/2008 | Coull | |
| 2011/0147007 | A1 | 6/2011 | O'Malley et al. | |
| 2011/0198097 | A1* | 8/2011 | Moen | E21B 34/08 166/373 |
| 2013/0075112 | A1 | 3/2013 | Franklin et al. | |

* cited by examiner

CRIMPING TO ADJUST FLUID FLOW FOR AUTONOMOUS INFLOW CONTROL DEVICES

BACKGROUND

The present invention generally relates to wellbore flow control devices and, more specifically, to making on-site field adjustments to autonomous inflow control assemblies.

In hydrocarbon production wells, it is often beneficial to regulate the flow of formation fluids from a subterranean formation into a wellbore penetrating the same. A variety of reasons or purposes can necessitate such regulation including, for example, prevention of water and/or gas coning, minimizing water and/or gas production, minimizing sand production, maximizing oil production, balancing production from various subterranean zones, equalizing pressure among various subterranean zones, and/or the like.

A number of devices are available for regulating the flow of formation fluids. Some of these devices are non-discriminating for different types of formation fluids and can simply function as a "gatekeeper" for regulating access to the interior of a wellbore pipe, such as a well string. Such gatekeeper devices can be simple on/off valves or they can be metered to regulate fluid flow over a continuum of flow rates. Other types of devices for regulating the flow of formation fluids can achieve at least some degree of discrimination between different types of formation fluids. Such devices can include, for example, tubular flow restrictors, nozzle-type flow restrictors, autonomous inflow control devices, non-autonomous inflow control devices, ports, tortuous paths, combinations thereof, and the like.

Autonomous inflow control devices (AICD) can be particularly advantageous in subterranean operations, since they are able to automatically regulate fluid flow without the need for operator control due to their design. In this regard, AICDs can be designed such that they provide a greater resistance to the flow of undesired fluids (e.g., gas and/or water) than they do desired fluids (e.g., oil), particularly as the percentage of the undesired fluids increases.

Several AICDs are often combined into an AICD system that can be manufactured to particular specifications and/or designs requested by well operators based on production needs for particular well sites. Such design specifications may include the required flow rate of fluids through the AICD system for normal operation. Upon receiving the AICD system at a well site, however, production needs for the well operator or a well site may have changed. For instance, the well operator may learn new information about the well, which would necessitate an AICD system configured for different production capabilities. Alternatively, the well operator may desire to use the manufactured AICD system at a different well site where the production needs and/or capabilities are different. Accordingly, it may prove advantageous to have an AICD system that is adjustable on-site by the well operator.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present invention generally relates to wellbore flow control devices and, more specifically, to making on-site field adjustments to autonomous inflow control assemblies.

Disclosed are various ways for a well operator to make on-site adjustments to autonomous inflow control device assemblies prior to deployment downhole in order to alter the fluid flow capacity of the autonomous inflow control device assemblies. As described herein below, a crimping tool may be used to crimp or otherwise plastically deform a shroud arranged about the autonomous inflow control device assembly such that the shroud isolates one or more autonomous inflow control devices associated with the assembly. In some cases, the crimping tool may have one or more axially extending fingers and each finger may have a profile defined on an inner surface thereof. A radial load may be applied to the fingers such that the profile is forced into engagement with the shroud and results in its plastic deformation. As a result, the well operator may have the ability to strategically adjust fluid flow capabilities of an autonomous inflow control device assembly in the field.

As used herein, the term "on-site" refers to a rig location or field location where an autonomous inflow control device (AICD) system or assembly may be delivered and otherwise following its discharge from a manufacturer's facility. The term may also refer to any location that the AICD system or assembly might encounter or otherwise be located prior to being deployed downhole for operation.

Figure 1:
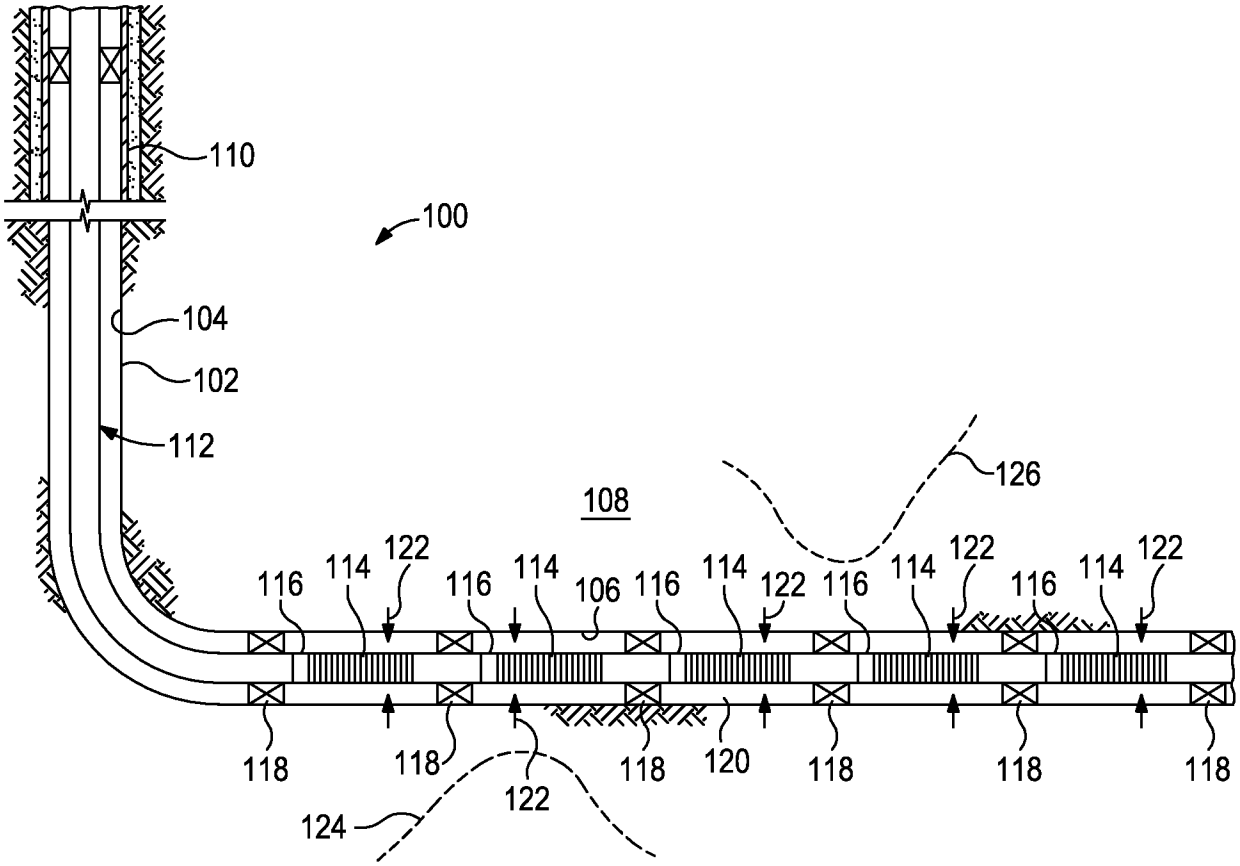
FIG. 1 illustrates a well system that can embody principles of the present disclosure, according to one or more embodiments.

Referring to FIG. 1, illustrated is a well system 100 that can embody principles of the present disclosure, according to one or more embodiments. As illustrated, the well system 100 may include a wellbore 102 that has a generally vertical uncased section 104 that transitions into a generally horizontal uncased section 106 extending through a subterranean earth formation 108. In some embodiments, the vertical section 104 may extend downwardly from a portion of the wellbore 102 having a string of casing 110 cemented therein. A tubular string, such as production tubing 112, may be installed in or otherwise extended into the wellbore 102.

One or more well screens 114, one or more flow control devices 116, and one or more packers 118 may be interconnected along the production tubular 112, such as along portions of the production tubular 112 in the horizontal section 106 of the wellbore 102. The packers 118 may be configured to seal off an annulus 120 defined between the production tubular 112 and the walls of the wellbore 102. As a result, fluids 122 may be produced from multiple intervals or "pay zones" of the surrounding subterranean formation 108 via isolated portions of the annulus 120 between adjacent pairs of the packers 118.

As illustrated, in some embodiments, a well screen 114 and a flow control device 116 may be interconnected in the production tubular 112 and positioned between a pair of packers 118. The well screens 114 may be swell screens, wire wrap screens, mesh screens, sintered screens, expandable screens, pre-packed screens, treating screens, or other known screen types. In operation, the well screen 114 may be configured to filter the fluids 122 flowing into the production tubular 112 from the annulus 120. The inflow control device 116 may be configured to restrict or otherwise regulate the flow of the fluids 122 into the production tubular 112, based on certain physical characteristics of the fluids.

It will be appreciated that the well system 100 of FIG. 1 is merely one example of a wide variety of well systems in which the principles of this disclosure can be utilized. Accordingly, it should be clearly understood that the principles of this disclosure are not necessarily limited to any of the details of the depicted well system 100, or the various components thereof, depicted in the drawings or otherwise described herein. For example, it is not necessary in keeping with the principles of this disclosure for the wellbore 102 to include a generally vertical wellbore section 104 or a generally horizontal wellbore section 106. Moreover, it is not necessary for fluids 122 to be only produced from the formation 108 since, in other examples, fluids could be injected into the formation 108, or fluids could be both injected into and produced from the formation 108, without departing from the scope of the disclosure.

Furthermore, it is not necessary that at least one well screen 114 and inflow control device 116 be positioned between a pair of packers 118. Nor is it necessary for a single inflow control device 116 to be used in conjunction with a single well screen 114. Rather, any number, arrangement and/or combination of such components may be used, without departing from the scope of the disclosure. In some applications, it is not necessary for a flow control device 116 to be used with a corresponding well screen 114. For example, in injection operations, the injected fluid could be flowed through a flow control device 116, without also flowing through a well screen 114.

It is not necessary for the well screens 114, flow control devices 116, packers 118 or any other components of the production tubular 112 to be positioned in uncased sections 104, 106 of the wellbore 102. Rather, any section of the wellbore 102 may be cased or uncased, and any portion of the production tubular 112 may be positioned in an uncased or cased section of the wellbore 102, without departing from the scope of the disclosure.

Those skilled in the art will readily recognize the advantages of being able to regulate the flow of fluids 122 into the production tubular 112 from each zone of the subterranean formation 108, for example, to prevent water coning 124 or gas coning 126 in the formation 108. Other uses for flow regulation in a well include, but are not limited to, balancing production from (or injection into) multiple zones, minimizing production or injection of undesired fluids, maximizing production or injection of desired fluids, etc. The exemplary flow control devices 116, as described in greater detail below, may provide such benefits by increasing resistance to flow if a fluid velocity increases beyond a selected level (e.g., to thereby balance flow among zones, prevent water coning 124 or gas coning 126, etc.), increasing resistance to flow if a fluid viscosity or density decreases below a selected level (e.g., to thereby restrict flow of an undesired fluid, such as water or gas, in an oil producing well), and/or increasing resistance to flow if a fluid viscosity or density increases above a selected level (e.g., to thereby minimize injection of water in a steam injection well).

Figure 2:
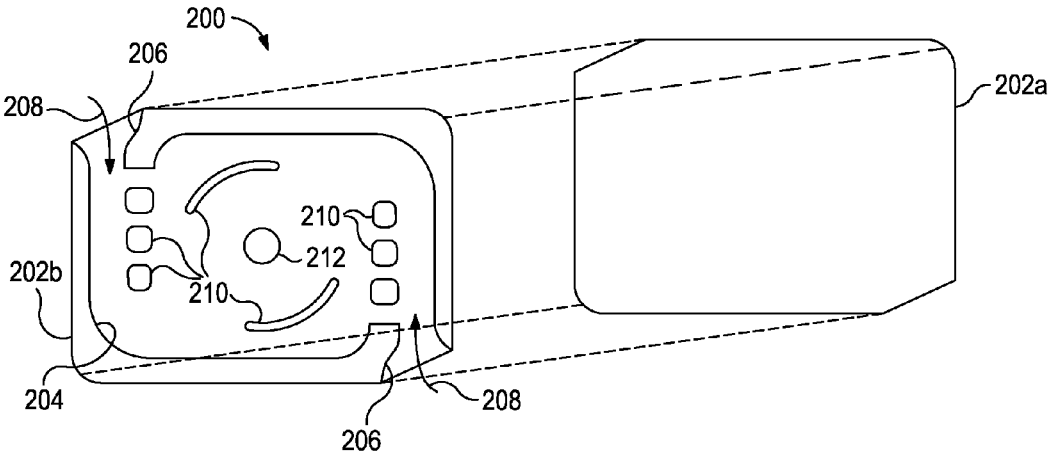
FIG. 2 illustrates an exploded top view of an exemplary autonomous inflow control device, according to one or more embodiments.

Referring now to FIG. 2, with continued reference to FIG. 1, illustrated is an exploded top view of an exemplary autonomous inflow control device 200, according to one or more embodiments. The autonomous inflow control device 200 (hereafter "AICD 200") may be any one of the flow control devices 116 shown in FIG. 1 and otherwise form part of an autonomous inflow control device (AICD) assembly. The AICD 200 may be made of tungsten carbide, but may equally be made of any other suitable materials known to those skilled in the art. As illustrated, the AICD 200 may include a top plate 202*a* and a bottom plate 202*b*. The top plate 202*a* may be configured to be coupled or otherwise secured to the bottom plate 202*b* in order to define a flow chamber 204 therebetween within the AICD 200. The top plate 202*a* may be coupled to the bottom plate 202*b* using a variety of techniques including, but not limited to, mechanical fasteners, adhesives, welding, brazing, heat shrinking, combinations thereof and the like.

The bottom plate 202*b* may define one or more fluid inlets 206 (two shown) that provide fluid access into the flow chamber 204. While two fluid inlets 206 are depicted in FIG. 2, those skilled in the art will readily recognize that the AICD 200 is shown merely for illustrative purposes and other exemplary AICDs may have only one fluid inlet or more than two fluid inlets, without departing from the scope of the disclosure. The fluid inlets 206 may be configured to receive a flow of a fluid 208 therethrough and direct the fluid 208 into the flow chamber 204. The fluid 208 may be a fluid composition originating from a surrounding formation 108 (FIG. 1), for example, and may include one or more fluid components, such as oil and water, oil and gas, gas and water, oil, water and gas, etc.

The bottom plate 202*b* of the AICD 200 may further provide or otherwise define various internal structures 210 and an outlet 212. The AICD 200 may be configured to resist the flow of the fluid 208 therethrough based on one or more characteristics of the fluid 208, such as density, viscosity, and/or velocity of the fluid 208 or its various fluid components. More specifically, the internal structures 210 may be configured to induce spiraling of the flow of the fluid 208 about the outlet 212. As a result, the fluid 208 may be subjected to centrifugal or vortex forces that may cause various components of the fluid 208 that are more viscous to collect or otherwise congregate more rapidly at the outlet 212, while components of the fluid 208 that are less viscous to flow to the outlet 212 less rapidly. As a result, the AICD 200 may provide a greater resistance to the flow of undesired fluids (e.g., water, gas, etc.) than desired fluids (e.g., oils), particularly as the percentage of the undesired fluids increases.

Figure 3A:
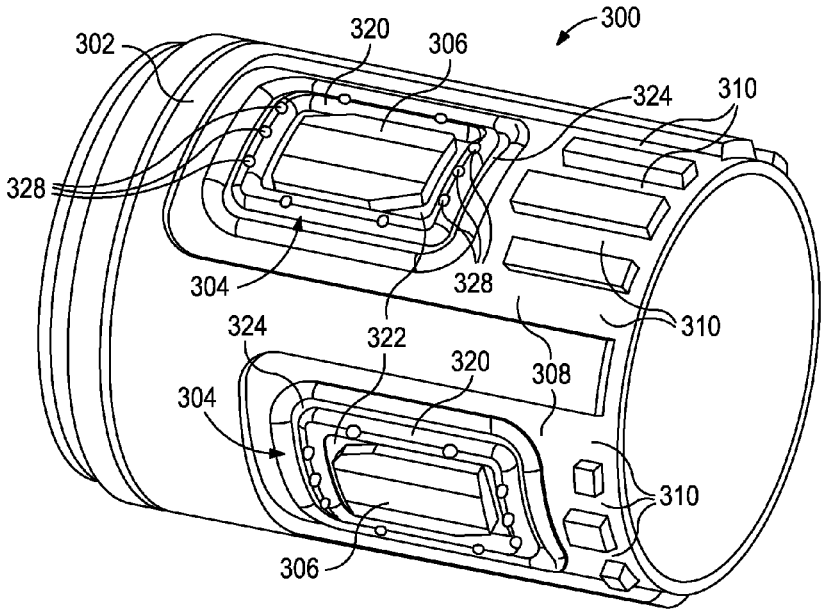
FIG. 3A depicts an isometric view of a portion of an exemplary autonomous inflow control device assembly, according to one or more embodiments.
Figure 3B:
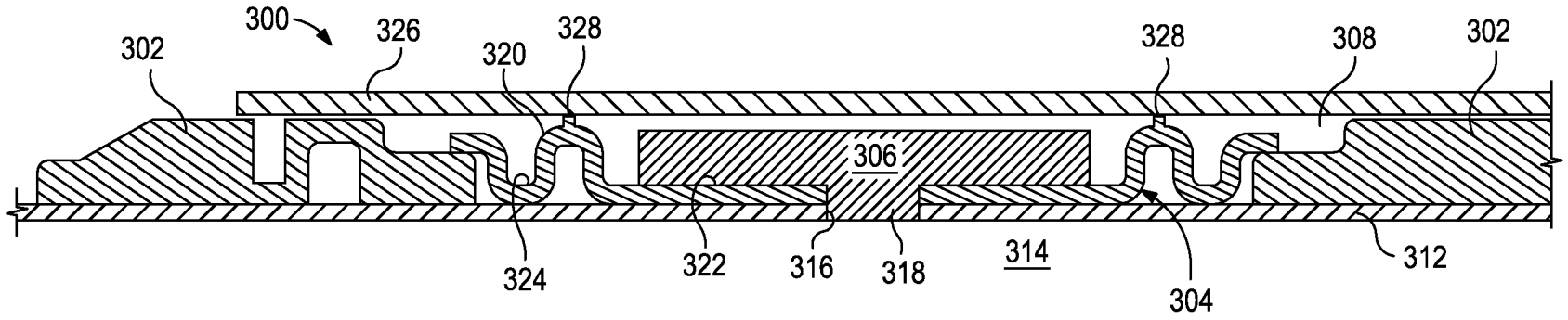
FIG. 3B depicts a cross-sectional side view of a portion of the autonomous inflow control device assembly of FIG. 3A, according to one or more embodiments.

Referring now to FIGS. 3A and 3B, with continued reference to FIGS. 1 and 2, illustrated is an exemplary autonomous inflow control device assembly 300, according to one or more embodiments. More particularly, FIG. 3A depicts an isometric view of the autonomous inflow control device assembly 300 (hereafter "AICD assembly 300") and FIG. 3B depicts a cross-sectional side view of a portion of the AICD assembly 300. As illustrated, the AICD assembly 300 may include a generally cylindrical housing 302, one or more buckles 304 arranged or positioned on the housing 302, and a corresponding one or more autonomous inflow control devices 306 (hereafter "AICD 306") secured within each buckle 304. The AICDs 306 used in the AICD assembly 300 may be similar to the AICD 200 of FIG. 2 and/or may be any one of the flow control devices 116 depicted in FIG. 1. In FIG. 3A, two buckles 304 and two corresponding AICDs 306 are depicted as being arranged on the housing 302. Those skilled in the art, however, will readily recognize that the AICD assembly 300 may include more or less than two buckles 304 and AICDs 306 arranged about the circumference of the housing 302, without departing from the scope of the disclosure.

The housing 302 may define or otherwise provide one or more fluid compartments 308 configured to receive and secure a combination of a buckle 304 and an AICD 306 therein. As best seen in FIG. 3A, the housing 302 may further define one or more flow conduits 310 that lead into or fluidly communicate with each flow compartment 308 and otherwise provide a flow path for fluids to enter or exit the fluid compartment 308. While not shown, the housing 302 may be in fluid communication with a well screen (i.e., one of the well screens 114 of FIG. 1) configured to draw in a fluid 208 (FIG. 2) from the annulus 120 (FIG. 1) and convey the fluid 208 into the fluid compartment 308 via the flow conduits 310. In other embodiments, however, the AICD assembly 300 may be used for injection operations, where an injection fluid is ejected out of the AICD 306, conveyed out of the fluid compartment 308 via the flow conduits 310, and subsequently injected into the surrounding formation 108 (FIG. 1) after having passed through the screens 114.

As best seen in FIG. 3B, the housing 302 may be arranged about the exterior of a base pipe 312 (not shown in FIG. 3A). The base pipe 312 may be or otherwise form part of the production tubing 112 of FIG. 1 and may define an interior 314 and one or more flow ports 316 configured to be in fluid communication with a corresponding AICD 306. In some embodiments, the AICD 306 may be shrink-fitted into the base pipe 312 and thereby secure the AICD 306 therein for downhole operation. More particularly, an outlet 318 of the AICD 306 may extend into and otherwise be secured within a corresponding flow port 316 of the base pipe 312, thereby placing the AICD 306 in fluid communication with the interior 314 of the base pipe 312. In other embodiments, the AICD 306 may be threaded, brazed, or welded into the flow port 316.

In yet other embodiments, the AICD 306 may be shrink-fitted, threaded, brazed, or welded into a corresponding buckle 304, without departing from the scope of the disclosure. More particularly, each buckle 304 may define or otherwise provide a main ridge member 320, a central cavity 322 interior to the main ridge member 320, and a trough 324 extending about the periphery of the main ridge member 320. The AICD 306 may be arranged within the central cavity 322 and the outlet 318 may extend at least partially through the central cavity 322 in order to place the AICD 306 in fluid communication with the interior 314 of the base pipe 312. Both the main ridge member 320 and the trough 324 may generally extend about the periphery of the AICD 306.

As shown in FIG. 3B, the AICD assembly 300 may also include a shroud 326 (not shown in FIG. 3A) that extends over and otherwise radially covers the fluid compartments 308. In some embodiments, the shroud 326 may be shrink-fitted, welded, or brazed to the housing 302. In other embodiments, the shroud 326 may be removably attached to the housing 302 to allow a well operator to access the fluid compartment 308 on-site prior to deploying the AICD assembly 300 downhole. In such embodiments, for example, the shroud 326 may be mechanically fastened or threaded to the housing 302. In some embodiments, one or more bumps or protrusions 328 may be defined on the main ridge member 320 and configured to maintain the shroud 326 radially offset from the main ridge member 320 a short distance so that fluids may be able to bypass the main ridge member 320 and access or exit the central cavity 322.

In some embodiments, it may be desired by a well operator to make on-site fluid flow adjustments to the AICD assembly 300 prior to deployment downhole. More particularly, a well operator may desire to reduce or eliminate fluid flow to one or more of the AICDs 306, and thereby reduce the amount of fluid flow entering the interior 314 of the base pipe 312. According to the present disclosure, this may be done by crimping or otherwise plastically deforming the shroud 326 such that the shroud 326 provides a fluid barrier that restricts fluid flow to and from the AICDs 306. To accomplish this, the shroud 326 may be made of a rigid or semi-rigid material that allows the shroud 326 to plastically deform upon assuming a radial pressure or mechanical force. In some embodiments, for example, the shroud 326 may be made of a metal, such as stainless steel or aluminum.

Figure 4A:
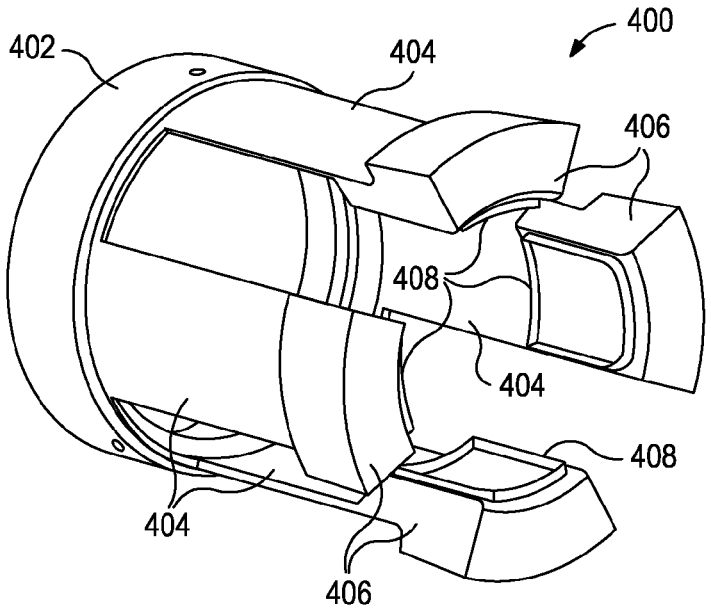
FIG. 4A depicts an isometric view of an exemplary crimping tool, according to one or more embodiments.
Figure 4B:
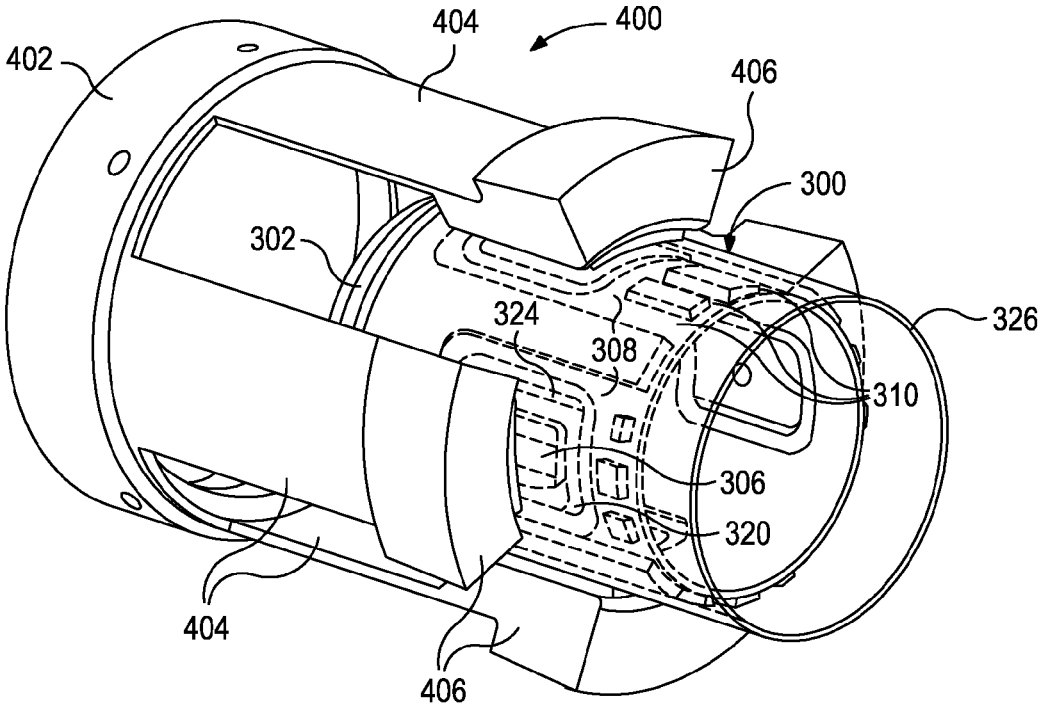
FIG. 4B depicts an isometric view of the crimping tool of FIG. 4A as used in conjunction with an autonomous inflow control device assembly, according to one or more embodiments.

Referring to FIGS. 4A and 4B, with continued reference to FIGS. 3A and 3B, illustrated is an exemplary crimping tool 400 that may be used to plastically deform the shroud 326, according to one or more embodiments. More particularly, FIG. 4A depicts an isometric view of the crimping tool 400, and FIG. 4B depicts an isometric view of the crimping tool 400 as used in conjunction with the AICD assembly 300. In FIG. 4B, the shroud 326 is depicted in phantom such that the above-described components of the AICD assembly 300 may be visible. As illustrated, the crimping tool 400 may be in the form of or otherwise characterized as a collet-type tool or device. In other embodiments, however, the crimping tool 400 may be a type of swaging device or tool that can equally be used to plastically deform the shroud 326.

In the illustrated embodiment, the crimping tool 400 may have an annular body 402 and one or more fingers 404 (four shown) that extend longitudinally from the annular body 402. The annular body 402 and the fingers 404 may be sized and otherwise configured to extend about the outer diameter of the AICD assembly 300. In other words, the inner diameter of the annular body 402 and the fingers 404 (or only the fingers 404) may be slightly larger than the outer diameter of the AICD assembly 300 (i.e., the shroud 326) such that at least the fingers 404 of the crimping tool 400 may be able to freely translate along an axial length of the AICD assembly 300.

Each finger 404 may have or otherwise provide a head 406 at its distal end. The inner radial surface of each head 406 may provide or otherwise define a crimping profile 408 (best seen in FIG. 4A) that extends radially from the head 405 and is used to engage and plastically deform the shroud 326. The design, shape, and configuration of the crimping profile 408 may be configured to correspond to a predetermined design, shape, or configuration of one or more features of the AICD assembly 300 and otherwise shaped such that it plastically deforms the shroud 326 to substantially isolate the AICDs 306 from any incoming fluids. For instance, as will be discussed below, the shape of the crimping profile 408 may be configured to generally correspond to the shape of the buckle 304, or the general shape of the central cavity 322 or the trough 324 associated with the buckle 304. In other embodiments, the shape of the crimping profile 408 may be configured to generally correspond to the shape of the fluid compartment 308. In yet other embodiments, the shape of the crimping profile 408 may be configured to plastically deform or swage the shroud 326 at or near the flow conduits 310 within the fluid compartment 308, thereby sealing off the flow conduits 310 between the AICD 306 and the housing 302 such that fluid is restricted from entering the fluid compartment 308 and interacting with the AICD 306.

In the illustrated embodiment, four fingers 404 are depicted as being included in the crimping tool 400. Each finger 404 may be configured to align and interact with a corresponding one of the AICDs 306, such that the number of AICDs 306 in the AICD assembly 300 is generally equal to the number of fingers 404. In other embodiments, however, the crimping tool 400 may include more or less fingers 404 than the number of AICDs 306. For instance, in at least one embodiment, the crimping tool 400 may have only one or two fingers 404 configured to align and interact with more than two AICDs 306, without departing from the scope of the disclosure.

Figure 5A:
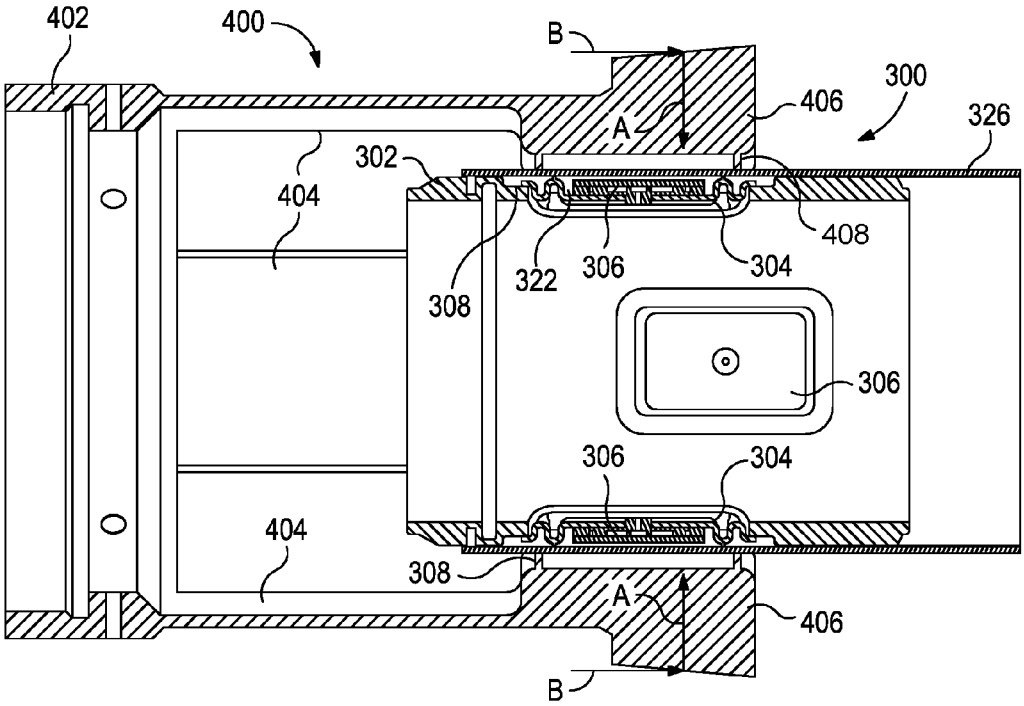
FIG. 5A illustrates a cross-sectional side view of a crimping tool and an autonomous inflow control device assembly prior to a crimping operation, according to one or more embodiments.
Figure 5B:
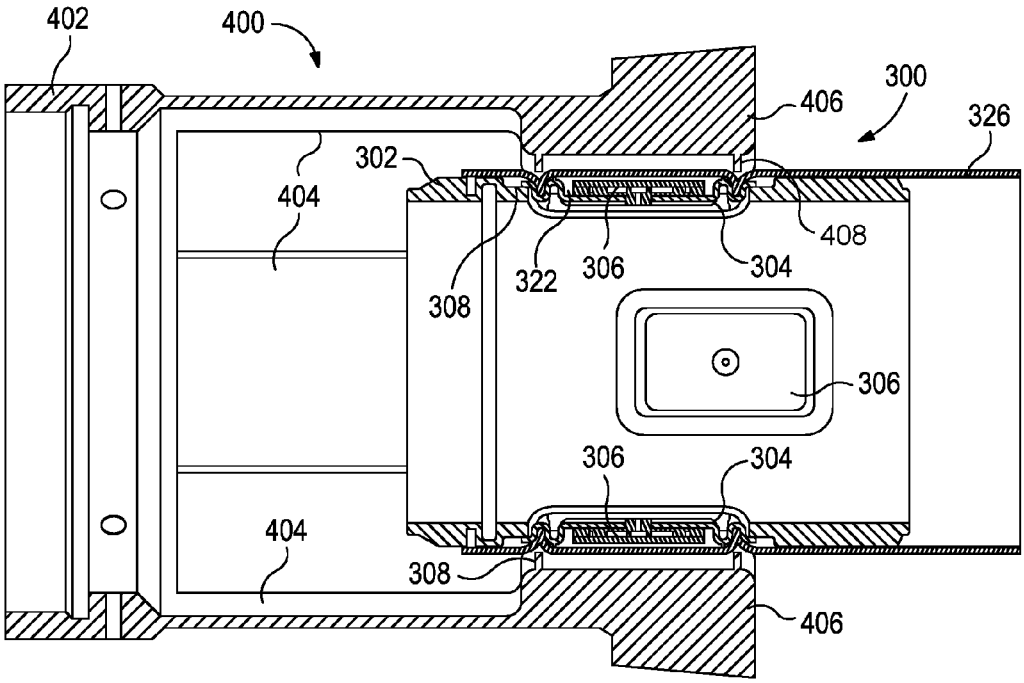
FIG. 5B illustrates a cross-sectional side view of a crimping tool and an autonomous inflow control device assembly following a crimping operation, according to one or more embodiments.

Referring now to FIGS. 5A and 5B, with continued reference to FIGS. 3A-3B and 4A-4B, exemplary operation of the crimping tool 400 as used on the AICD assembly 300 is depicted, according to one or more embodiments. More particularly, FIG. 5A illustrates a cross-sectional side view of the crimping tool 400 and the AICD assembly 300 prior to a crimping operation, and FIG. 5B illustrates a cross-sectional side view of the crimping tool 400 and the AICD assembly 300 following a crimping operation. It should be noted that the base pipe 312 described above and illustrated in FIG. 3B is not depicted in FIGS. 5A-5B but would otherwise be disposed within the AICD assembly 300 during a typical crimping operation.

In order for a well operator to crimp the AICD assembly 300, and thereby undertake on-site fluid flow adjustments to the AICD assembly 300, the crimping tool 400 may be generally extended over the end of the AICD assembly 300. The crimping tool 400 may be advanced along the axial length of the AICD assembly 300 until at least one of the heads 406 of the fingers 404 aligns with a desired or predetermined location on the shroud 326. The predetermined location refers to a location on the AICD assembly 300 where the well operator desires to plastically deform the shroud 326 using the crimping tool 400. In some embodiments, the predetermined location may be marked or otherwise visibly designated on the shroud 326 and the well operator may be able to align the crimping tool 400 with the markings. As can be appreciated, aligning the crimping tool 400 at the predetermined location may require the crimping tool 400 to be axially and/or angularly moved with respect to the AICD assembly 300.

Once the crimping tool 400 is located at the predetermined location, a radial load may be applied to the head 406, as indicated by the arrows A. In some embodiments, the radial load A may be applied through a radial impact force, such as with a blunt instrument or object (e.g., sledge hammer, etc.). In other embodiments, the radial load A may result from the use of any suitable actuator or actuation device known to those skilled in the art. Suitable actuation devices may operate hydraulically, mechanically, electrically, electromechanically, pneumatically, or any combination thereof.

In yet other embodiments, the radial load A may result from the application of an axial load, as indicated by the arrows B, as applied to the head 406. More particularly, as illustrated, the outer radial surface of the head 406 may be beveled, angled, or otherwise tapered in an axial direction, thereby defining a beveled or angled surface. A ring or other annular cylindrical structure (not shown) may be extended partially over the head 406 and forced against the head 406 in the axial direction B. As a result of the beveled surface of the head 406, the axial load B against the head 406 translates into the radial load A required to force the head 406 into radial engagement with the shroud 326. Similar to the radial load A, the axial load B may be realized using any suitable actuator or actuation device known to those skilled in the art, and may operate hydraulically, mechanically, electrically, electromechanically, pneumatically, or any combination thereof.

Upon applying the radial load A, the profile 408 may be forced into radial engagement with the outer surface of the shroud 326. Continued and increased application of the radial load A may result in the shroud 326 being plastically deformed radially in the general shape or configuration of the profile 408. This is shown in FIG. 5B, where the shroud 326 is shown as having been bent or forced into the trough 324 of the buckles 304 in accordance with the shape of the profile 408. Once bent or plastically deformed into the trough 324, the shroud 326 then generally encompasses the AICD 306 and therefore serves as a fluid barrier or restrictor to the influx of fluids into the AICD 306. As a result, the overall fluid flow capacity or capability into the interior 314 (FIG. 3B) of the base pipe 312 (FIG. 3B) is reduced.

While the profiles 408 in the depicted embodiment are designed to match the general shape or design of the trough 324, those skilled in the art will readily appreciate that the design of the profiles 408 may be configured to plastically deform the shroud 326 in any shape or form capable of substantially isolating the AICD 306 from the influx of fluids. For instance, the profiles 408 may be designed or otherwise configured to match the general shape or design of the AICD 306 and thereby plastically deform the shroud 326 directly about the periphery of the AICD 306 and otherwise within the central cavity 322. The profile 408 may also be designed or otherwise configured to match the general shape of the fluid compartment 308 and thereby plastically deform the shroud 326 about the inner periphery of the fluid compartment 308. In further embodiments, the profile 408 may be designed or otherwise configured to plastically deform the shroud 326 within a portion of the fluid compartment 308 such that the flow conduits 310 (FIG. 3A) are substantially occluded with the shroud 326. In other words, the profile 408 may be configured as a type of swage device that plastically deforms the shroud 326 so that fluid flow through the flow conduits 310 to/from the fluid compartment 308 is substantially prevented.

Accordingly, a well operator may be able to make on-site fluid flow adjustments to the AICD assembly 300 prior to its deployment downhole. The well operator may be able to use the crimping tool 400 on-site to selectively crimp the shroud 326 about each of the AICDs or about a desired number of AICDs 306 and thereby selectively reduce the flow of fluid 208 into the interior 314 of the base pipe 312. Once the desired on-site fluid flow adjustments have been made, the AICD assembly 300 may then be deployed downhole for operation.

Embodiments disclosed herein include:

A. An autonomous inflow control device (AICD) assembly that includes a housing arranged about a base pipe that defines at least one flow port and an interior, the housing defining a fluid compartment in fluid communication with the at least one flow port, an AICD arranged in the fluid compartment and having at least one fluid inlet and an outlet in fluid communication with the at least one flow port, a shroud coupled to the housing and covering the fluid compartment, and a crimping tool arrangeable about the housing and the shroud and having a profile defined thereon, the profile being configured to engage and plastically deform the shroud in order to fluidly isolate the AICD.

B. A method that includes receiving an autonomous inflow control device (AICD) assembly subsequent to its manufacture, the AICD assembly including a housing arranged about a base pipe defining at least one flow port and the housing defining a fluid compartment in fluid communication with the at least one flow port, wherein the AICD assembly further includes an AICD arranged in the fluid compartment and a shroud coupled to the housing and covering the fluid compartment, arranging a crimping tool about the AICD assembly, the crimping tool having a profile defined thereon, applying a radial load on the crimping tool to force the profile into radial engagement with the shroud, plastically deforming the shroud with the crimping tool and thereby fluidly isolating the AICD within the housing, and deploying the AICD assembly into a wellbore and reducing an influx of fluid into the AICD with the shroud as plastically deformed.

Each of embodiments A and B may have one or more of the following additional elements in any combination: Element 1: wherein the shroud is made of at least one of stainless steel and aluminum. Element 2: wherein the profile exhibits a shape configured to plastically deform the shroud around the AICD. Element 3: further comprising one or more flow conduits defined in the housing and facilitating fluid communication between the fluid compartment and an exterior of the housing, wherein the profile exhibits a shape configured to plastically deform the shroud within the fluid compartment and occlude the one or more flow conduits. Element 4: wherein the crimping tool comprises an annular body, one or more fingers extending longitudinally from the annular body, and a head provided at a distal end of each finger, wherein the profile is defined on an inner radial surface of the head of each finger. Element 5: wherein a radial load is applied to the head in order to plastically deform the shroud. Element 6: wherein the head has a beveled outer radial surface and the radial load is applied through the application of an axial load applied on the beveled outer radial surface. Element 7: further comprising a buckle disposed within the fluid compartment, the buckle providing a main ridge member, a central cavity defined interior to the main ridge member, and a trough extending about the periphery of the main ridge member, wherein the AICD is arranged in the central cavity. Element 8: wherein the profile exhibits a shape corresponding to a shape of the trough such that the shroud is plastically deformed into the trough. Element 9: wherein the profile exhibits a shape configured to plastically deform the shroud within the central cavity and around a periphery of the AICD. Element 10: wherein the profile exhibits a shape configured to plastically deform the shroud around an inner periphery of the fluid compartment.

Element 11: wherein plastically deforming the shroud comprises plastically deforming the shroud around the AICD. Element 12: wherein the AICD assembly further includes one or more flow conduits defined in the housing and facilitating fluid communication between the fluid compartment and an exterior of the housing, and wherein plastically deforming the shroud comprises occluding the one or more flow conduits with the shroud. Element 13: wherein the crimping tool includes an annular body, one or more fingers extending longitudinally from the annular body, and a head provided at a distal end of each finger, and wherein applying the radial load on the crimping tool comprises applying the radial load to the head of at least one of the one or more fingers, wherein the profile is defined on an inner radial surface of the head of each finger, and plastically deforming the shroud as the profile is forced into radial engagement with the shroud. Element 14: wherein the head has a beveled outer radial surface, and wherein applying the radial load to the head comprises applying an axial load on the beveled outer radial surface, the axial load being translated into the radial load upon engaging the beveled outer radial surface. Element 15: wherein the AICD assembly further includes a buckle disposed within the fluid compartment and providing a main ridge member, a central cavity configured to receive the AICD, and a trough extending about the periphery of the main ridge member, and wherein plastically deforming the shroud comprises plastically deforming the shroud into the trough, the profile exhibiting a shape corresponding to a shape of the trough. Element 16: wherein the AICD assembly further includes a buckle disposed within the fluid compartment and providing a main ridge member, a central cavity configured to receive the AICD, and a trough extending about the periphery of the main ridge member, and wherein plastically deforming the shroud comprises plastically deforming the shroud within the central cavity and around a periphery of the AICD. Element 17: wherein the AICD assembly further includes a buckle disposed within the fluid compartment and providing a main ridge member, a central cavity configured to receive the AICD, and a trough extending about the periphery of the main ridge member, and wherein plastically deforming the shroud comprises plastically deforming the shroud around an inner periphery of the fluid compartment. Element 18: wherein arranging the crimping tool about the AICD assembly comprises advancing the crimping tool axially to a predetermined location on the shroud, and angularly adjusting the crimping tool with respect to the AICD assembly, if needed, in order to radially align the crimping tool at the predetermined location.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" does not require selection of at least one item; rather, the phrase allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. An autonomous inflow control device (AICD) assembly, comprising:

a housing arranged about a base pipe that defines at least one flow port and an interior, the housing defining a fluid compartment in fluid communication with the at least one flow port;

an AICD arranged in the fluid compartment and having at least one fluid inlet and an outlet in fluid communication with the at least one flow port;

a shroud coupled to the housing and covering the fluid compartment; and a crimping tool having a profile defined on an inner radial surface thereof and being arrangeable about the housing and an outer circumference of the shroud, the profile being configured to radially engage and plastically deform the shroud to fluidly isolate the AICD.

2. The AICD assembly of claim 1, wherein the shroud is made of at least one of stainless steel and aluminum.

3. The AICD assembly of claim 1, wherein the profile exhibits a shape configured to plastically deform the shroud around the AICD.

4. The AICD assembly of claim 1, further comprising one or more flow conduits defined in the housing and facilitating fluid communication between the fluid compartment and an exterior of the housing, wherein the profile exhibits a shape configured to plastically deform the shroud within the fluid compartment and occlude the one or more flow conduits.

5. The AICD assembly of claim 1, wherein the crimping tool comprises:

an annular body;

one or more fingers extending longitudinally from the annular body; and a head provided at a distal end of each finger, wherein the profile is defined on an inner radial surface of the head of each finger.

6. The AICD assembly of claim 5, wherein a radial load is applied to the head in order to plastically deform the shroud.

7. The AICD assembly of claim 6, wherein the head has a beveled outer radial surface and the radial load is applied through the application of an axial load applied on the beveled outer radial surface.

8. The AICD assembly of claim 1, further comprising a buckle disposed within the fluid compartment, the buckle providing a main ridge member, a central cavity defined interior to the main ridge member, and a trough extending about the periphery of the main ridge member, wherein the AICD is arranged in the central cavity.

9. The AICD assembly of claim 8, wherein the profile exhibits a shape corresponding to a shape of the trough such that the shroud is plastically deformed into the trough.

10. The AICD assembly of claim 8, wherein the profile exhibits a shape configured to plastically deform the shroud within the central cavity and around a periphery of the AICD.

11. The AICD assembly of claim 8, wherein the profile exhibits a shape configured to plastically deform the shroud around an inner periphery of the fluid compartment.

12. A method, comprising:

arranging a crimping tool about an autonomous inflow control device (AICD) assembly, the AICD assembly including:

a housing arranged about a base pipe and defining a fluid compartment in fluid communication with at least one flow port defined in the base pipe;

an AICD arranged in the fluid compartment; and a shroud coupled to the housing and covering the fluid compartment, wherein the crimping tool is arranged about an outer circumference of the shroud;

applying a radial load on the crimping tool to force a profile defined on an inner radial surface thereof into radial engagement with the shroud;

plastically deforming the shroud with the crimping tool and thereby fluidly isolating the AICD within the housing; and deploying the AICD assembly into a wellbore and reducing an influx of fluid into the AICD with the shroud as plastically deformed.

13. The method of claim 12, wherein plastically deforming the shroud comprises plastically deforming the shroud around the AICD.

14. The method of claim 12, wherein the AICD assembly further includes one or more flow conduits defined in the housing and facilitating fluid communication between the fluid compartment and an exterior of the housing, and wherein plastically deforming the shroud comprises occluding the one or more flow conduits with the shroud.

15. The method of claim 12, wherein the crimping tool includes an annular body, one or more fingers extending longitudinally from the annular body, and a head provided at a distal end of each finger, and wherein applying the radial load on the crimping tool comprises:

applying the radial load to the head of at least one of the one or more fingers, wherein the profile is defined on an inner radial surface of the head of each finger; and plastically deforming the shroud as the profile is forced into radial engagement with the shroud.

16. The method of claim 15, wherein the head has a beveled outer radial surface, and wherein applying the radial load to the head comprises applying an axial load on the beveled outer radial surface, the axial load being translated into the radial load upon engaging the beveled outer radial surface.

17. The method of claim 12, wherein the AICD assembly further includes a buckle disposed within the fluid compartment and providing a main ridge member, a central cavity configured to receive the AICD, and a trough extending about the periphery of the main ridge member, and wherein plastically deforming the shroud comprises:

plastically deforming the shroud into the trough, the profile exhibiting a shape corresponding to a shape of the trough.

18. The method of claim 12, wherein the AICD assembly further includes a buckle disposed within the fluid compartment and providing a main ridge member, a central cavity configured to receive the AICD, and a trough extending about the periphery of the main ridge member, and wherein plastically deforming the shroud comprises:

plastically deforming the shroud within the central cavity and around a periphery of the AICD.

19. The method of claim 12, wherein the AICD assembly further includes a buckle disposed within the fluid compartment and providing a main ridge member, a central cavity configured to receive the AICD, and a trough extending about the periphery of the main ridge member, and wherein plastically deforming the shroud comprises:

plastically deforming the shroud around an inner periphery of the fluid compartment.

20. The method of claim 12, wherein arranging the crimping tool about the AICD assembly comprises at least one of:

advancing the crimping tool axially to a predetermined location on the shroud; and angularly adjusting the crimping tool with respect to the AICD assembly angularly align the crimping tool at the predetermined location.

* * * * *